United States Patent [19]

Ford

[11] Patent Number: 4,598,278

[45] Date of Patent: Jul. 1, 1986

[54] EARLY WARNING OF MARINE COOLING SYSTEM FAILURE

[75] Inventor: John R. Ford, Xenia, Ohio

[73] Assignee: Vernay Laboratories, Inc., Yellow Springs, Ohio

[21] Appl. No.: 461,081

[22] Filed: Jan. 26, 1983

[51] Int. Cl.[4] ..... G08B 21/00; G08B 23/00

[52] U.S. Cl. ..... 340/608; 123/41.05; 340/606; 340/984; 440/2

[58] Field of Search ..... 340/52 R, 56, 516, 606, 340/607, 608, 63, 506, 60, 984; 307/315; 210/85, 87, 108; 440/2

[56] References Cited

U.S. PATENT DOCUMENTS

| | | | |
|---|---|---|---|
| 930,171 | 8/1909 | Foley | 340/608 |
| 3,493,951 | 2/1970 | Hartka | 340/606 |
| 3,864,260 | 2/1975 | Banner | 210/108 |
| 3,908,578 | 9/1975 | Buelk | 115/6.1 |
| 3,921,398 | 11/1975 | Kashmerick | 60/310 |
| 3,967,239 | 6/1976 | Steele | 340/63 |
| 3,992,695 | 11/1976 | Mogi | 340/60 |
| 4,013,904 | 3/1977 | Chick | 307/315 |
| 4,036,162 | 7/1977 | Maier et al. | 115/17 |
| 4,061,571 | 12/1977 | Banner | 123/41.09 |
| 4,136,330 | 1/1979 | Estaque | 340/57 |
| 4,160,733 | 7/1979 | Nelson | 210/85 |
| 4,350,010 | 9/1982 | Yukishima | 60/310 |
| 4,441,102 | 4/1984 | Webb | 340/608 |

OTHER PUBLICATIONS

Joseph Lucas Ltd., "'Failsafe' Condition Monitoring System Fitted on SSV2", May 1972.

*Primary Examiner*—John W. Caldwell, Sr.
*Assistant Examiner*—Brent A. Swarthout
*Attorney, Agent, or Firm*—Biebel, French & Nauman

[57] ABSTRACT

An early warning system detects the failure of a marine cooling system by monitoring the presence of water within the cooling system so that an alarm is given upon cessation or a severe reduction of water flow therethrough. A water sensing element is inserted within the cooling system preferably within an exhaust system of a marine engine cooled by the cooling system and a detection circuit is connected to the water sensing element. An alarm signal is generated by the detection circuit if insufficient water flow is sensed by the water sensing element. The circuit preferably comprises a darlington amplifier having a power input terminal, a power output terminal and a control terminal. A resistor and a capacitor are connected in parallel between the power input terminal and the control terminal of the darlington amplifier, the water sensing element is connected to the control terminal and an audible or visual or combined audible and visual alarm device is connected to the power output terminal.

8 Claims, 4 Drawing Figures

EARLY WARNING OF MARINE COOLING SYSTEM FAILURE

BACKGROUND OF THE INVENTION

This invention relates to watercraft which rely upon a flow of water from an outside supply for cooling marine engines and associated equipment within the watercraft and, more particularly, to an alarm system for providing an early warning of the failure of a marine cooling system.

Watercraft which utilize internal combustion engines for propulsion and/or auxiliary purposes standardly use the water supporting the craft for cooling purposes. Water for circulation within a marine cooling system is pumped via an engine driven water pump up through an open-ended water inlet conduit which extends into the water supporting the craft. The water may be circulated through a water jacket or manifold to absorb heat directly or the water may be circulated through heat exchangers which also receive engine coolant, gear lubricants, transmission fluid or the like for indirect absorbtion of heat. In any event, once the water has absorbed heat generated by the engine, transmission and/or other associated equipment, the water is returned to the body of water supporting the craft typically through an engine exhaust conduit.

All waterways include a certain amount of natural debris such as weeds, leaves, and the like, as well as unnatural debris such as plastic bags, paper, and the like. Accordingly, a coarse strainer is often provided across the open end of the water inlet to prevent large pieces of debris from entering the cooling system. While the coarse strainer prevents large pieces of debris from entering the cooling system, the strainer itself may be partially or totally blocked and prevent the proper flow of cooling water from entering the cooling system water inlet conduit.

Blockage of the strainer resulting in a cessation or severe reduction of the water flow through the water inlet conduit and thereby the marine cooling system eventually causes the marine engine and any associated equipment cooled by the cooling system to overheat. While the engine temperature is ordinarily displayed on a temperature gauge in the craft's cabin, oftentimes the gauge will go unnoticed permitting excessively high temperatures to develop. Such high temperatures can not only ruin the engine, transmission and/or associated equipment cooled by the cooling system but can also start fires and burn holes in the manifold and/or exhaust system, which holes can permit dangerous fumes or water to enter the craft upon further operation. In large inboard boats, packing glands which seal the passage of propeller drive shafts through the hull may also be cooled by the cooling system. Failure of such glands due to overheating can result in sizeable holes surrounding the drive shafts and could sink a boat.

U.S. Pat. Nos. 4,160,733 and 3,864,260 disclose cleaning systems for marine engine cooling water inlets. The cleaning system of the former patent is activated manually or upon the detection of an elevated engine temperature and the cleaning system of the latter patent is activated manually or in response to the activation of a vacuum switch which monitors the vacuum within the water inlet. While these patents appear to present viable cleaning systems, activation of a cleaning system upon detection of an elevated engine temperature may not prevent damage from overheating, and the use of a vacuum switch to monitor the water inlet presents complications and is less than absolutely reliable.

It is thus apparent that the need exists for a reliable, inexpensive, simply constructed early warning system for the detection of failures of marine cooling systems prior to the overheating of a marine engine or associated equipment cooled by the cooling system.

SUMMARY OF THE INVENTION

In accordance with the present invention, an early warning system is provided for detecting the failure of a marine cooling system wherein cooling water is drawn from the body of water supporting a watercraft utilizing a marine engine. Cooling water is drawn through a water inlet tube, circulated to cool the engine and discharged back to the body of water after having absorbed heat generated by operation of the engine. The early warning system detects the presence of water in the cooling system so that an alarm can be given upon cessation or a severe reduction of the water flow therethrough.

The early warning system in accordance with the present invention comprises a water sensing element supported within the cooling system of a marine engine, circuit means connected to the water sensing element for generating an alarm signal if water is not sensed by the water sensing element, and alarm means responsive to the alarm signal for warning the operator of the watercraft of impending engine overheating. The water sensing element is preferably supported within an exhaust system of the marine engine into which cooling water is discharged, although placement of the element within other portions of the cooling system which receive flowing water during proper cooling system operation is contemplated in accordance with the present invention.

In accordance with one aspect of the present invention, electrical power for the circuit means is connected through an ignition switch for the marine engine, whereby the early warning system is self-checking in that an alarm is initially activated when the ignition is turned on to start the engine and then the alarm is extinguished as long as water properly flows through the cooling system.

The circuit means of the early warning system preferably comprises a darlington amplifier having a power input terminal, a power output terminal, and a control terminal and a parallel combination of a resistance and a capacitance connected between the power input terminal and the control terminal of the darlington amplifier with the water sensing element being connected to the control terminal, the alarm means being connected to the power output terminal, and the electrical power being connected to the power input terminal.

The water sensing element preferably comprises a threaded fastener having a noble metal head extending into the cooling system with the fastener being insulated from and sealed into the cooling system and providing an electrical connection to the noble metal head external to the cooling system. It is contemplated that either a visual or an audible alarm device, or preferably both, be utilized in accordance with the present invention.

It is, therefore, an object of the present invention to provide an early warning system for detecting the failure of a marine cooling system by detecting cessation or severe reduction of water flowing through the cooling system.

It is an other object of the present invention to provide an early warning system for detecting the failure of a marine cooling system by inserting a water sensing element within an exhaust system of a marine engine served by the cooling system, monitoring the water sensing element by circuit means connected thereto which generates an alarm signal if water is not sensed within the exhaust system by the sensing element, and providing alarm means responsive to the alarm signal for warning the operator of the watercraft utilizing the marine cooling system of impending overheating.

Other objects and advantages of the invention will be apparent from the following description, the accompanying drawings, and the appended claims.

DETAILED DESCRIPTION OF THE INVENTION

Figure 1:
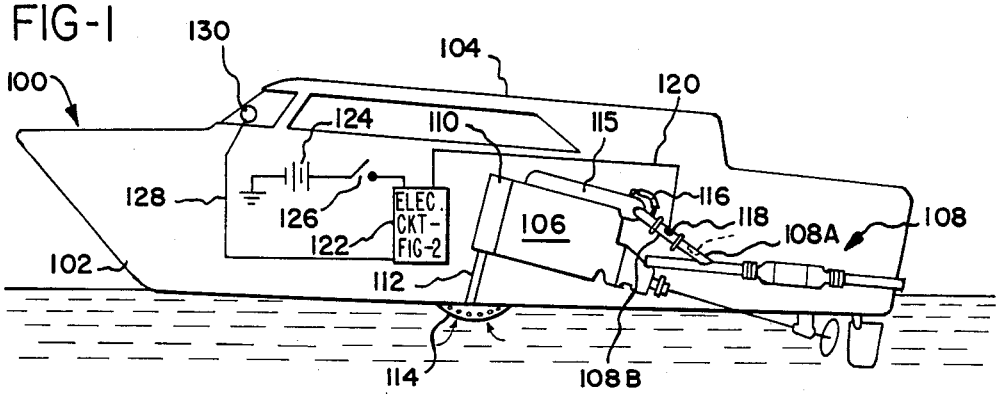
FIG. 1 is a schematic view of a watercraft showing an inboard marine engine incorporating an early warning system in accordance with the present invention.

The invention will now be described with reference to FIG. 1 which shows a watercraft 100 comprising a hull 102 and cabin 104. The watercraft 100 is shown as an inboard pleasure boat having an inboard engine 106 and an exhaust system 108 connected thereto. It is noted, however, that the present invention is applicable to any marine engine, inboard, outboard or inboard/-outboard, whether used for propulsion or for auxiliary purposes such as pumping water or generating electricity for use on the watercraft.

The inboard engine 106 drives a water pump 110 which draws engine cooling water through a water inlet conduit 112 from beneath the hull 102. Water enters the water inlet conduit 112 through a relatively coarse strainer 114 which prevents large debris from entering the inlet conduit 112 and clogging the internal passages of the cooling system for the engine 106.

Water is pumped through the water inlet 112 by the water pump 110 to a cooling manifold 115 which forms a portion of the engine 106 and ultimately exits through the exhaust system 108 by being injected thereinto through a small conduit 116. A water sensing element 118 extends into the exhaust system 108 in a water-tight sealed engagement therewith. Placement of the water sensing element in the exhaust system is preferred since the hot exhaust gases quickly dry the water sensing element 118 to provide a more rapid warning upon cessation or severe reduction of the flow of cooling water. However, the element can also be placed within other portions of the cooling system which receive flowing water during normal operation of the cooling system and are above the water line or will otherwise be vacated upon cessation or a severe reduction of cooling water flow. An electrical conductor 120 extends from the water sensing element 118 to circuit means 122, an illustrative embodiment of which is shown schematically in FIG. 2.

Electrical power is connected to the circuit means 122 from a boat battery 124 or other direct current (DC) voltage source through a contact 126 of an ignition switch which controls and starts the marine engine 106. The circuit means 122 generates an alarm signal which is passed via an electrical conductor 128 to alarm means 130 mounted within the cabin 104 of the watercraft 100. In accordance with the present invention, the alarm means 130 can be an audible alarm device or a visual alarm device or, preferably, a combination of the two.

Figure 2:
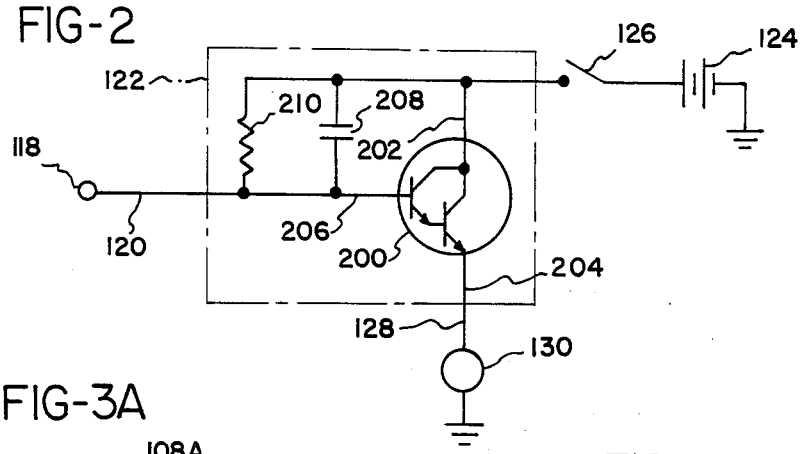
FIG. 2 is a schematic diagram of circuit means for use in the early warning system of the present invention.

FIG. 2 is a schematic diagram of a preferred embodiment of the circuit means 122 of FIG. 1. In accordance with this embodiment, the circuit means is simply and inexpensively constructed from a darlington amplifier 200 having a power input terminal 202 connected to a contact 126 of the marine engine ignition switch, a power output terminal 204 connected to the alarm means 130 via the conductor 128, and a control terminal 206. A capacitor 208 and a resistor 210 are connected in parallel between the power input terminal 202 and the control terminal 206, with the control terminal 206 also being connected to the water sensing element 118. The capacitor 208 and resistor 210 are selected to maintain the darlington amplifier 200 deactivated over pulses of water droplets resulting from anticipated reductions in the water flow, for example, due to reduced engine speed.

In accordance with one feature of the present invention, the early warning system is self-checking. When the ignition switch is activated to start the marine engine 106, the darlington amplifier 200 is initially activated to pass an alarm signal to the alarm means 130. This initial activation is ensured by mounting the water sensing element 118 above the water line such that water is not initially sensed by the water sensing element 118, i.e., the water sensing element is not grounded.

As soon as the marine engine 106 drives the water pump 110 sufficiently to pump cooling water into the exhaust system 108 and the water sensing element 118 senses and is grounded thereby, the darlington amplifier 200 is deactivated so that the alarm signal passed via the conductor 128 to the alarm means 130 is extinguished. However, in the event that the flow of water through the cooling system ceases or is substantially blocked such that the water sensing element 118 is ungrounded for a sufficient period of time as defined by the capacitor 208 and the resistor 210, the darlington amplifier 200 once again activates the alarm means 130.

The invention thus provides an early warning system of impending overheating of the engine 106 and any associated equipment cooled by the cooling system as soon as a lack of cooling water flow in the cooling system, preferably the engine exhaust system 108, is detected. Early corrective measures can then be taken to prevent the marine engine 106 and associated equipment from overheating and thereby prevent potential damage to the engine, transmission, boat, cooling system and, of course, occupants of the boat.

Figure 3A:
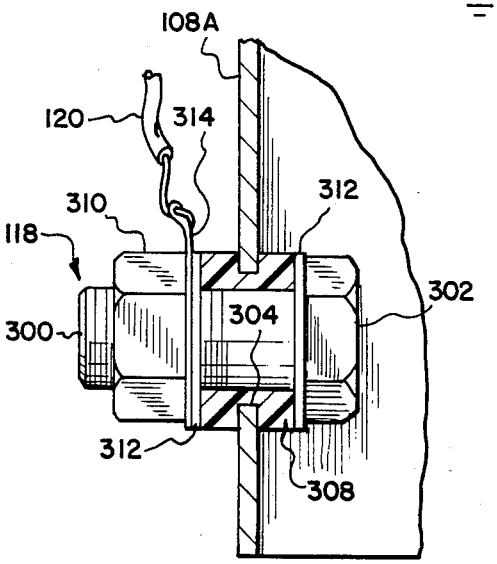
FIGS. 3A and 3B are cross-sectional views through portions of the engine exhaust system of FIG. 1 showing illustrative water sensing elements for use in the present invention.

FIG. 3A shows an illustrative embodiment of the water sensing element 118 extending through a section of the exhaust pipe 108A of the exhaust system 108. As shown in FIG. 3A, the water sensing element 118 comprises a bolt 300 having a noble metal head 302 which extends into the exhaust pipe 108A. The noble metal head 302 of the bolt 300 is electrically conducting yet resistant to the corrosive effects of the cooling water drawn through the inlet conduit 112.

As shown in FIG. 3A, the bolt 300 may be conveniently inserted through a hole 304 formed in the side wall of the exhaust pipe 108A near an open end 306 which may be joined to adjacent sections of the exhaust system 108. The bolt 300 is insulated from the exhaust pipe 108A by means of a grommet 308 constructed from rubber or other electrically insulating material. It may be desirable to construct the grommet 308 from a heat-resistant material when the water sensing element is located in the exhaust pipe 108A to ensure that it is not damaged by hot exhaust gases.

As shown in FIG. 3A, the bolt 300 is secured to the exhaust pipe 108A by means of a nut 310 and washers 312 positioned on either side of the grommet 308. An electrically conducting wire lug 314 is secured between the outer washer 312 and the nut 310 with the conductor 120 being secured to the lug 314 for electrical connection to the bolt head 302. Alternately, the threaded shaft of the bolt 300 may be constructed of a material to which solder will adhere such that the conductor 120 may be directly wrapped and soldered to the threaded shaft of the bolt 300. This, as well as other alternative electrical connections can be made to the noble metal head 302 of the bolt 300.

Figure 3B:
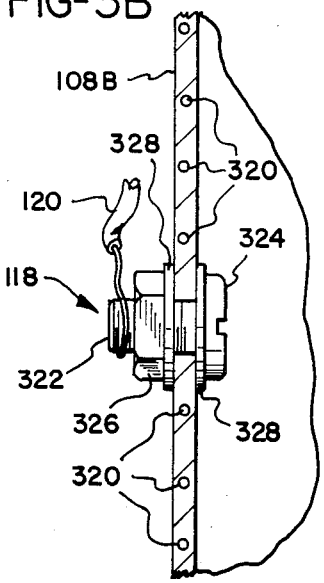

FIG. 3B shows an alternative installation of the water sensing element 118 into the exhaust system 108 when a flexible section 108B is included within the exhaust system 108. Such flexible sections are often included to prevent engine motion from being transmitted to the exhaust system. The flexible section 108B of the exhaust system may comprise a rubber hose reinforced by spiraling spring wire 320.

When such a flexible exhaust section is available, it is convenient to pierce the section and insert a screw 322 or other threaded fastener having a noble metal head 324 into the resulting hole. The screw 322 is secured to the flexible section 108B by a nut 326 and washers 328 such that the screw 322 is in watertight engagement with the flexible exhaust section 108B.

The location of the screw 322 in the flexible exhaust section 108B must be carefully selected to avoid potential grounding of the screw 322 through the reinforcing wire 320. The screw 322 is shown as comprising solderable metal such that the conductor 120 is soldered to the threaded end exterior to the exhaust system 108.

While the forms of apparatus herein described constitute preferred embodiments of this invention, it is to be understood that the invention is not limited to these precise forms of apparatus and that changes may be made therein without departing from the scope of the invention, which is defined in the appended claims.

What is claimed is:

1. In a marine cooling system wherein cooling water is drawn from the body of water supporting a watercraft utilizing a marine engine, said water being drawn through a water inlet, circulated to cool said engine, and discharged back to said body of water through an exhaust conduit of said engine, an early warning system for detecting the failure of said marine cooling system comprising:

a water sensing element supported within and electrically insulated from said exhaust conduit, said sensing element being exposed within said exhaust conduit and grounded by water within said exhaust conduit, said water serving as an electrical conductor to ground the exposed portion of said water sensing element within said exhaust conduit;

circuit means connected to said water sensing element for generating an alarm signal if water flow is not sensed within said exhaust conduit as indicated by ground being removed from said sensing element due to the rapid drying of said sensing element within said exhaust conduit; and alarm means responsive to said alarm signal for warning the operator of said watercraft of impending engine overheating upon detection of a lack of water flow in said cooling system.

2. The early warning system of claim 1 wherein electrical power for said circuit means is connected through a contact of an ignition switch for said marine engine whereby said early warning system is self-checking in that the alarm is initially activated when the ignition is turned on to start the engine and then is extinguished as long as water flows properly through said cooling system.

3. In a marine cooling system wherein cooling water is drawn from the body of water supporting a watercraft utilizing a marine engine, said water being drawn through a water inlet, circulated to cool said engine, and discharged back to said body of water, an early warning system for detecting the failure of said marine cooling system comprising:

a water sensing element supported within said cooling system;

circuit means connected to said water sensing element for generating an alarm signal if water flow is not sensed within said cooling system by said sensing element, said circuit means comprising a darlington amplifier having a power input terminal, a power output terminal, and a control terminal; and a parallel combination of a resistor and a capacitor connected between said power input terminal and said control terminal; and alarm means responsive to said alarm signal for warning the operator of said watercraft of impending engine overheating upon detection of a lack of water flow in said cooling system wherein said water sensing element is connected to said control terminal, said alarm means is connected to said power output terminal, and said electrical power is connected to said power input terminal through a contact of an ignition switch for said marine engine whereby said early warning system is self-checking in that the alarm is initially activated when the ignition is turned on to start the engine and then is extinguished as long as water flows properly through said cooling system.

4. The early warning system of claim 3 wherein said marine engine includes an exhaust system and said water sensing element is supported within said exhaust system.

5. The early warning system of claim 4 wherein said water sensing element comprises a threaded fastener having a noble metal head secured into said exhaust system, said fastener being insulated from and sealed into said exhaust system and providing an electrical connection to said noble metal head external to said exhaust system.

6. The early warning system of claim 5 wherein said alarm means comprises a visible alarm device.

7. The early warning system of claim 5 wherein said alarm means comprises an audible alarm device.

8. The early warning system of claim 5 wherein said alarm means comprises a visible alarm device and an audible alarm device.

* * * * *